US005396763A

United States Patent [19]

Mayer et al.

[11] Patent Number: 5,396,763

[45] Date of Patent: Mar. 14, 1995

[54] COOLED SPRAYBAR AND FLAMEHOLDER ASSEMBLY INCLUDING A PERFORATED HOLLOW INNER AIR BAFFLE FOR IMPINGEMENT COOLING AN OUTER HEAT SHIELD

[75] Inventors: Jeffrey C. Mayer, Swampscott; John A. Manteiga, North Andover, both of Mass.

[73] Assignee: General Electric Company, Cincinnati, Ohio

[21] Appl. No.: 233,104

[22] Filed: Apr. 25, 1994

[51] Int. Cl.[6] ..... F23R 3/20

[52] U.S. Cl. ..... 60/261; 60/39.32; 60/749

[58] Field of Search ..... 60/39.32, 39.83, 261, 60/262, 266, 737, 738, 740, 749, 754

[56] References Cited

U.S. PATENT DOCUMENTS

| | | | |
|---|---|---|---|
| 2,780,061 | 2/1957 | Clarke et al. | 60/740 |
| 2,799,991 | 7/1957 | Conrad | 60/261 |
| 2,861,424 | 11/1958 | Jurisich | 60/749 |
| 3,054,259 | 9/1962 | Arthur et al. | 60/749 |
| 3,176,465 | 4/1965 | Colley, Jr. | 60/39.72 |
| 3,384,346 | 5/1968 | Halls et al. | 60/262 |
| 3,601,985 | 8/1971 | Bauger | 60/749 |
| 3,698,186 | 10/1972 | Beane et al. | 60/39.72 R |
| 3,793,838 | 2/1974 | Nash | 60/261 |
| 3,800,527 | 4/1974 | Marshall et al. | 60/39.72 |
| 3,800,530 | 4/1974 | Nash | 60/261 |
| 4,064,691 | 12/1977 | Nash | 60/266 |
| 4,312,185 | 1/1982 | Nash et al. | 60/739 |
| 4,461,146 | 7/1984 | DuBell | 60/261 |
| 4,490,973 | 1/1985 | Kinsey | 60/261 |
| 4,751,815 | 6/1988 | Moore | 60/261 |
| 4,817,378 | 4/1989 | Giffin, III et al. | 60/261 |
| 4,887,425 | 12/1989 | Vdoviak | 60/261 |
| 4,901,527 | 2/1990 | Nash et al. | 60/261 |
| 4,989,407 | 2/1991 | Grant, Jr. | 60/261 |
| 5,001,898 | 3/1991 | Holladay | 60/261 |
| 5,020,318 | 6/1991 | Vdoviak | 60/261 |
| 5,076,062 | 12/1991 | Abreu | 60/749 |
| 5,121,608 | 6/1992 | Willis et al. | 60/738 |
| 5,142,858 | 9/1992 | Ciokajlo et al. | 60/39.33 |
| 5,179,832 | 1/1993 | Barcza et al. | 60/261 |
| 5,297,390 | 3/1994 | Sood | 60/740 |
| 5,335,490 | 8/1994 | Johnson et al. | 60/261 |

OTHER PUBLICATIONS

Gopalan et al, "Integrated Approach to the F414 Afterburner," Winter 1994, pp: Cover, 3, 12–15, and back.

*Primary Examiner*—Timothy S. Thorpe

*Attorney, Agent, or Firm*—Jerome C. Squillaro; David L. Narciso

[57] ABSTRACT

A cooled flameholder assembly includes a first heat shield having first and second spaced apart chambers. A fuel spraybar is disposed inside the first chamber, and a hollow baffle is disposed inside the second chamber. A second heat shield is joined to the first heat shield for closing the second chamber with the baffle therein. The baffle includes an inlet for receiving cooling air which is discharged through a plurality of outlet holes for impingement cooling the first and second heat shields.

11 Claims, 4 Drawing Sheets

COOLED SPRAYBAR AND FLAMEHOLDER ASSEMBLY INCLUDING A PERFORATED HOLLOW INNER AIR BAFFLE FOR IMPINGEMENT COOLING AN OUTER HEAT SHIELD

The U.S. Government has rights in this invention in accordance with Contract No. N00019-91-C-0114 awarded by the Department of the Navy.

CROSS REFERENCE TO RELATED APPLICATION

The present invention is related to concurrently filed U.S. patent application Ser. No. 08/233,101, filed Apr. 25, 1994 entitled "Ignition Flameholder."

The present invention relates generally to gas turbine engines, and, more specifically, to a flameholder assembly in an augmenter or afterburner thereof.

BACKGROUND OF THE INVENTION

In high performance, military aircraft gas turbine engines, an afterburner or augmenter is disposed downstream of a core engine for providing additional thrust when desired. The augmenter includes an outer casing, a combustion liner and a plurality of circumferentially spaced apart fuel spraybars for injecting additional fuel when desired for augmenting thrust. Since the augmenter receives high velocity core gases from the core engine, flameholders are typically required in the augmenter to provide stable regions downstream of the fuel spraybars for ensuring effective combustion of the injected fuel without blowout.

Although the augmenter environment is substantially hot due to the combustion process when the augmenter is in operation, the flameholders are typically uncooled and therefore have a limited useful life. Cooled flameholders are known in the art for improving useful life of the flameholders. However, the introduction of a cooling fluid in the hot environment of the augmenter necessarily creates substantial differences in temperature between the relatively cold and hot components of the flameholder. Flameholder designs having integral components subject to large differences in temperature from hot to cold are subject to low cycle fatigue therefrom which again limits the useful life of the flameholder assembly.

SUMMARY OF THE INVENTION

A cooled flameholder assembly includes a first heat shield having first and second spaced apart chambers. A fuel spraybar is disposed inside the first chamber, and a hollow baffle is disposed inside the second chamber, A second heat shield is joined to the first heat shield for closing the second chamber with the baffle therein. The baffle includes an inlet for receiving cooling air which is discharged through a plurality of outlet holes for impingement cooling the first and second heat shields.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
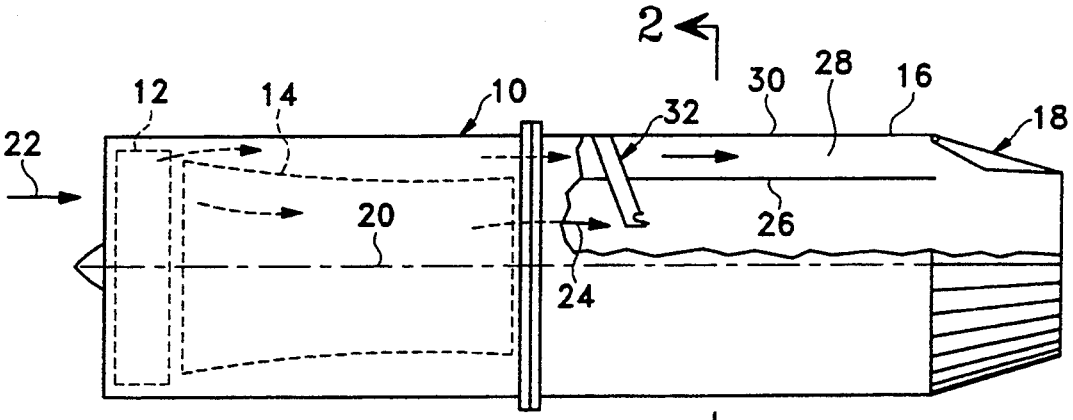
FIG. 1 is a schematic representation of an exemplary aircraft gas turbine engine having an augmenter with a cooled flameholder assembly in accordance with one embodiment of the present invention.

Illustrated schematically in FIG. 1 is an exemplary aircraft gas turbine engine 10 having a conventional fan 12 powered by a conventional turbine core engine 14, an afterburner or augmenter 16 disposed downstream therefrom, and a conventional variable area exhaust nozzle 18 disposed downstream therefrom, all being disposed axisymmetrically around a longitudinal or axial centerline axis 20.

During operation, ambient air 22 enters the fan 12 and a portion thereof is channeled through the core engine 14 wherein it is compressed, mixed with fuel, and ignited for generating combustion gases which power one or more turbine stages for rotating the fan 12. The spent combustion gases are discharged from the core engine as core gases 24 and flow downstream through a conventional augmenter combustion liner 26 of the augmenter 16, which are in turn discharged through the nozzle 18. A portion of the ambient air 22 bypasses the core engine 14 and flows axially downstream in a bypass duct 28 defined between the augmenter liner 26 and an annular outer casing 30 disposed radially outwardly thereof. The air 22 is used to conventionally cool the augmenter liner 26 which has a plurality of conventional film cooling holes therein (not shown).

Figure 2:
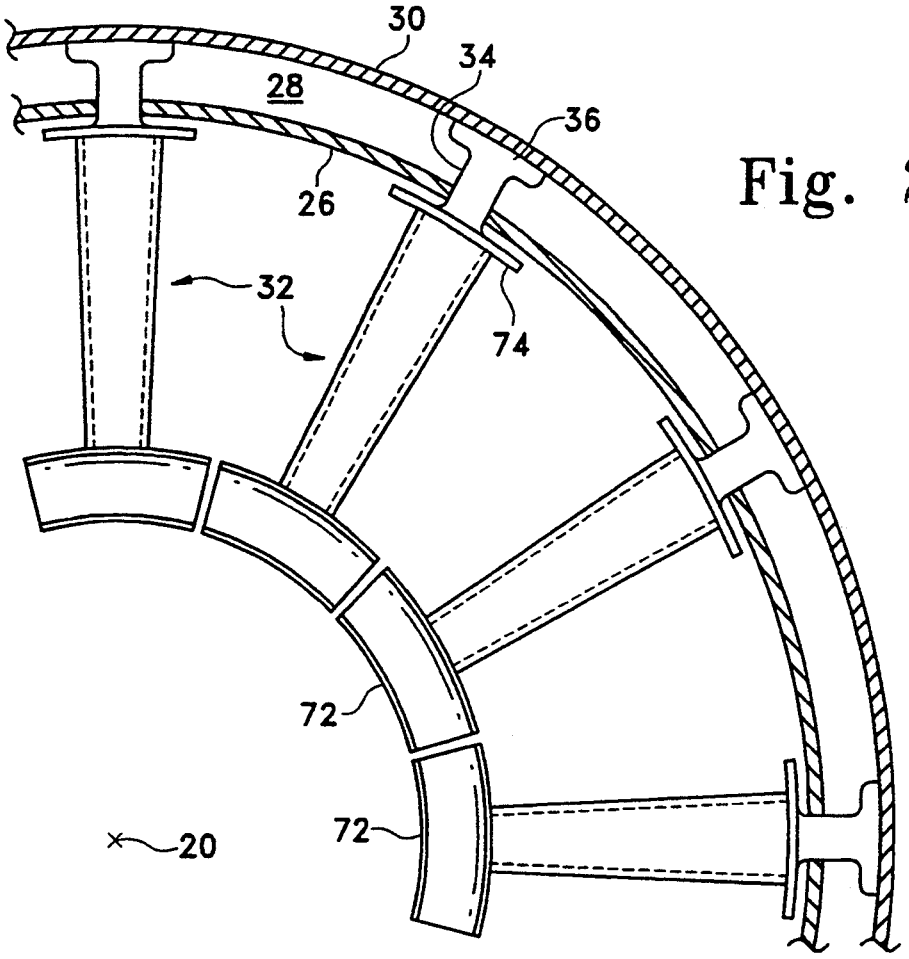
FIG. 2 is a quarter section view of circumferentially adjacent ones of the cooled flameholders illustrated in FIG. 1 and taken along line 2—2.

A flameholder assembly 32 in accordance with one embodiment of the present invention extends from the outer casing 30 and through the augmenter liner 26 at an upstream end thereof. FIG. 2 illustrates exemplary ones of the flameholder assemblies 32 which are disposed circumferentially adjacent to each other around the centerline axis 20 for collectively forming a complete annular and axisymmetrical flameholder structure.

Figure 3:
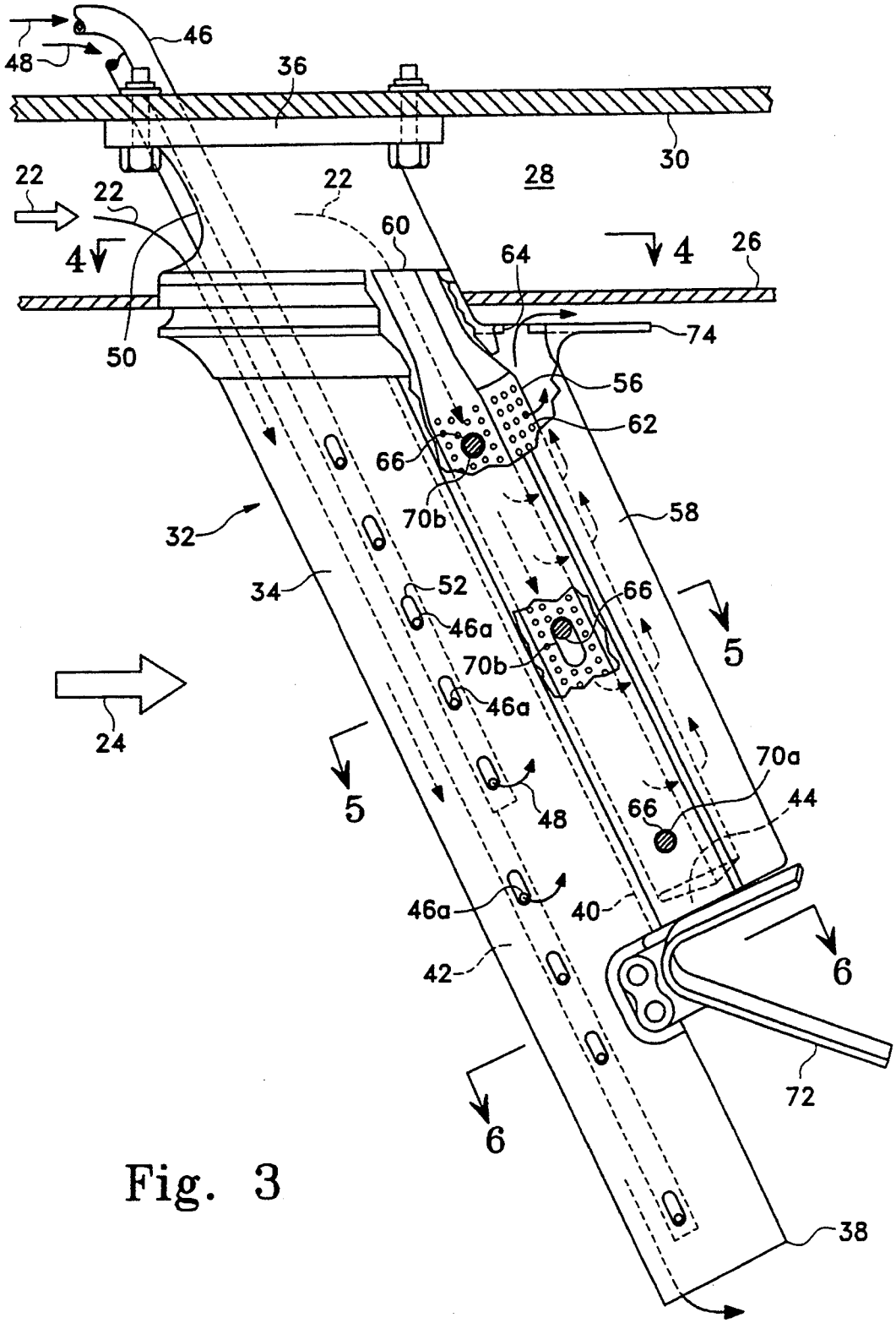
FIG. 3 is an enlarged lateral or side view of an exemplary one of the cooled flameholder assemblies illustrated in FIG. 1.

FIG. 3 illustrates in more particularity an exemplary one of the flameholder assemblies 32. Each flameholder assembly, or simply flameholder, 32 includes a first or forward heat shield 34 having a support end 36 at a radially outer end thereof for being conventionally mounted to the outer casing 30 by a plurality of bolts. The first heat shield 34 is longitudinally, or radially, elongate and is swept back or inclined in a downstream direction with its radially inner end 38 being suspended inside the augmenter liner 26 and disposed downstream from the support end 36.

Figure 4:
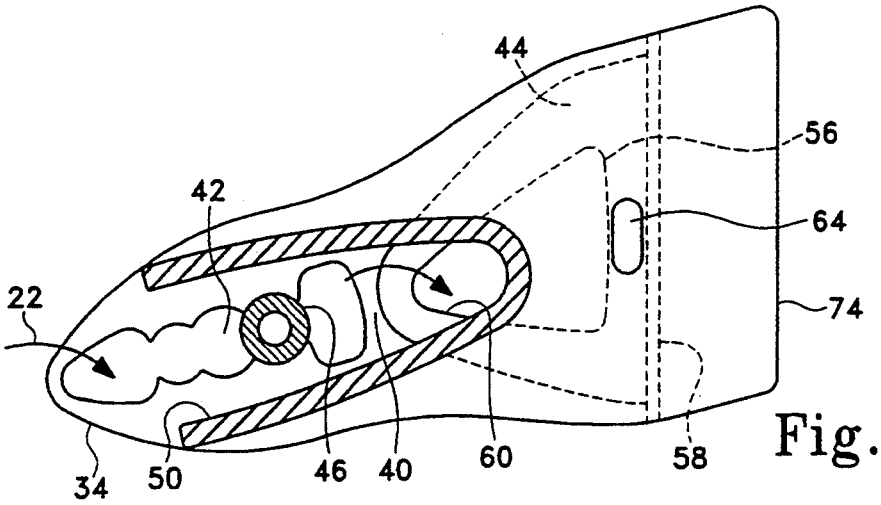
FIG. 4 is a radial, partly sectional view of the flameholder assembly illustrated in FIG. 3 and taken along line 4—4.
Figure 5:
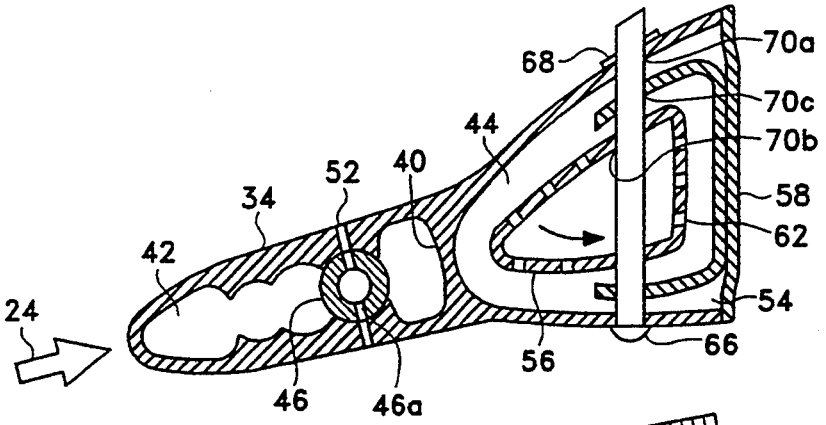
FIG. 5 is a radial, partly sectional view of the flameholder assembly illustrated in FIG. 3 and taken along line 5—5.
Figure 6:
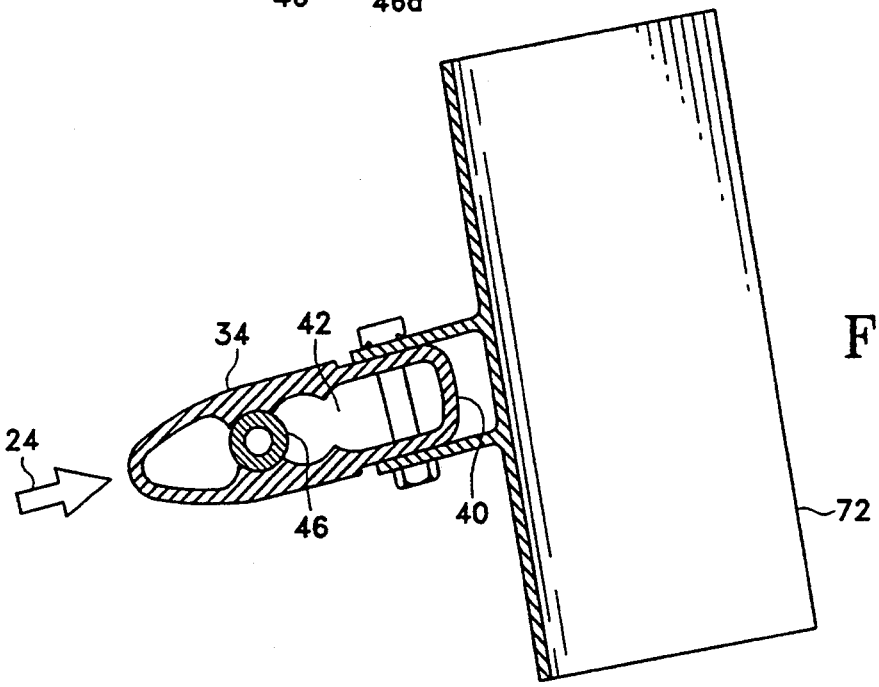
FIG. 6 is a radial, partly sectional view of the flameholder assembly illustrated in FIG. 3 and taken along line 6—6.

In an exemplary embodiment, the first heat shield 34 has a radially extending, imperforate septum 40 disposed centrally therein as illustrated in FIGS. 3–6 which divides the first heat shield 34 into radially elongate, generally parallel, first and second chambers 42 and 44, respectively. As illustrated most clearly in FIG. 5, the first chamber 42 is enclosed on all four sides and extends from the top of the first heat shield 34 adjacent the support end 36 to the inner end 38 (see also FIGS. 3, 4, and 6). The first chamber 42 is configured for receiving therein a conventional fuel spraybar 46 having one or more fuel tubes or legs as conventionally known. The fuel spraybar 46 includes a plurality of longitudinally spaced apart fuel outlets 46a on both lateral sides thereof as illustrated in FIGS. 3 and 5 for discharging fuel 48 from the first heat shield 34 inside the augmenter liner 26 when desired. The fuel spraybar 46 extends radially outwardly from adjacent the inner end 38 of the first heat shield 34 inside the first chamber 42 and through both the augmenter liner 26 and the outer casing 30 and is joined to a conventional fuel supply for selectively providing fuel thereto when desired.

As shown in FIGS. 3 and 4, the first heat shield 34 includes an air inlet 50 in the form of a V-slot opening in an upstream direction in the bypass duct 28 for receiving a portion of the cooling air 22 therein. The air 22 is channeled by the inlet 50 radially inwardly through the first chamber 42 and is discharged from the first heat shield 34 through an outlet at the inner end 38 thereof. In this way, the upstream portion of the first heat shield 34 is cooled by the air 22 channeled through the first chamber 42 thereof. The fuel spraybar 46 is conventionally supported at its radially outer end and is therefore suspended inside the first chamber 42 and is free to expand without restraint from the first heat shield 34 itself. In this way, the relatively hot first heat shield 34 which is heated by the core gases 24 is allowed to expand at a greater rate than that of the relatively cool fuel spraybar 46.

Fuel from the spraybar outlets 46a is discharged laterally therefrom and through the first heat shield 34 itself through a plurality of radially spaced apart fuel ports 52 which are aligned with respective ones of the fuel outlets 46a. As shown in FIG. 3, the fuel ports 52 are preferably radially elongated, with the fuel outlets 46a being initially aligned with the radially inner ends thereof so that as the first heat shield 34 is heated and expands during operation, the fuel ports 52 still provide access for discharging the fuel 48 from the fuel outlets 46*a*.

Figure 7:
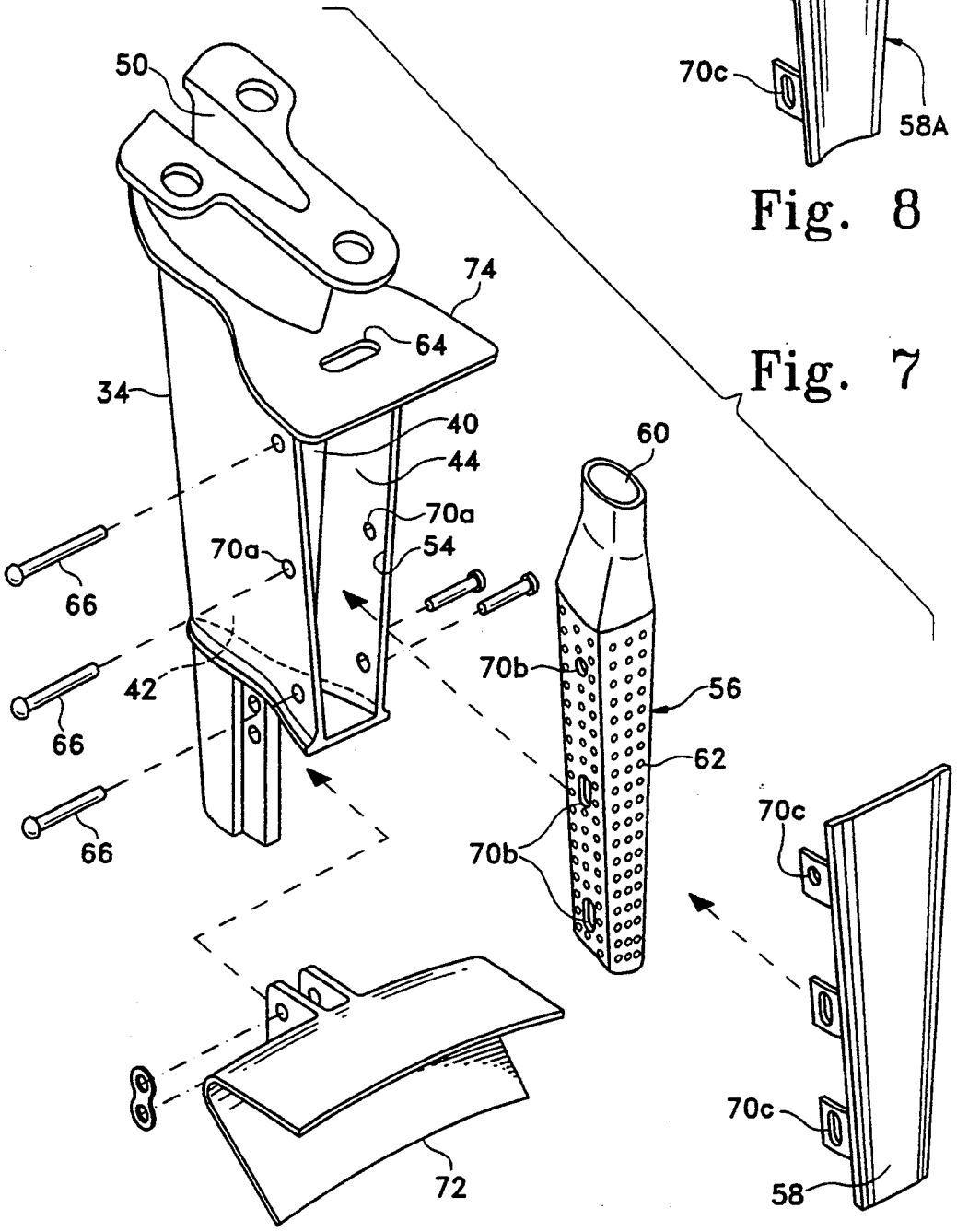
FIG. 7 is an exploded, perspective view of the flameholder assembly illustrated in FIG. 1 showing assembly of several components thereof.

The second chamber 44 of the first heat shield 34 is illustrated in more particularity in FIGS. 5 and 7. The second chamber 44 is generally U-shaped in radial section and is enclosed on three sides, with an open fourth side facing in the downstream direction relative to the direction of flow of the core gases 24 to define a radially and circumferentially extending access opening 54 along the one or aft side thereof.

Disposed inside the second chamber 44 is a hollow cooling baffle 56 which may be readily positioned therein through the access opening 54. A second heat shield 58, or back plate, is removably joined to the first heat shield 34 as shown in FIGS. 3, 5, and 7 for closing the access opening 54. In the embodiment illustrated in these Figures, the first chamber 42 is disposed on an upstream end of the first heat shield 34 relative to the direction of the core gases 24 flowable thereover, and the second chamber 44 is disposed on the downstream end of the first heat shield 34. When the fuel 48 is discharged from the fuel spraybar 46 during augmenter operation, it flows downstream from the first heat shield 34 and is ignited (by an ignition system not shown) for generating additional combustion gases for providing additional thrust. The augmenter combustion process necessarily generates hot combustion gases which radiate upstream toward and convectively scrub the second heat shield 58. The second heat shield 58 therefore faces downstream toward the hot combustion gases for providing a substantially cooled thermal shield against the high heat flux directed upstream toward the flameholder assembly 32. The second heat shield 58 in the preferred embodiment is substantially flat for providing flameholding capability which is effected since the flat second heat shield 58 provides an aerodynamic stagnation or wake region behind the flameholder assembly 32 having reduced velocity for enhancing stability of the combustion flames.

As illustrated in FIGS. 3, 5, and 7, the baffle 56 is disposed inside the second chamber 44 to provide a predetermined clearance between the walls defining the second chamber 44 and the inside surface of the second heat shield 58. The baffle 56 has an inlet 60 as shown in more particularity in FIGS. 3 and 4, disposed at the radially outer end thereof for receiving a portion of the cooling air 22 from the common inlet 50. The cooling air 22 flows radially inwardly into the baffle 56 and is discharged through a plurality of spaced apart outlet holes 62 disposed in all sides thereof for discharging the cooling air 22 in impingement against the inside surface of the second heat shield 58 and the walls defining the second chamber 44 of the first heat shield 34 for impingement cooling thereof. In this way, the first and second heat shields 34,58 which are heated during operation may be cooled from inside by the impingement cooling air directed thereagainst from the baffle outlet holes 62.

As illustrated in FIGS. 3, 4, and 7, the first heat shield 34, preferably also includes a spent air outlet 64 disposed adjacent to the top support end 36 in flow communication with the second chamber 44 for discharging therefrom the cooling air 22 discharged from the baffle outlet holes 62 after impingement against the first and second heat shields 34,58. The outlet 64 is preferably disposed adjacent to and radially inwardly of the augmenter liner 26 to ensure that the spent cooling air 22 is discharged into the augmenter liner 26 adjacent its radially inner surface and away from the main combustion gases. In this way, the stability of the combustion gases is not affected by the spent cooling air 22, and additional cooling is also provided for the liner 26 to guard against hot streaks. Furthermore, in the event the second heat shield 58 is damaged during operation with a hole burned therethrough, the spent cooling air 22 may then be discharged from such burned hole for reducing further damage to the second heat shield 58.

The second chamber 44, the baffle 56, and the second heat shield 58 are all subject to different operating temperatures which must be accommodated for preventing undesirably large stresses which could decrease the useful lives thereof. Accordingly, in the preferred embodiment of the present invention, means are provided for supporting the baffle 56 in the second chamber 44 for allowing substantially unrestrained thermal expansion between the baffle 56 and the first heat shield 34 which contains the second chamber 44. In the preferred embodiment of the invention, the supporting means also supports the second heat shield 58 on the first heat shield 34 for allowing substantially unrestrained thermal expansion between the second heat shield 58 and the first heat shield 34.

More specifically, and referring to FIGS. 3, 5, and 7, a preferred embodiment of the supporting means includes a plurality of longitudinally spaced apart pins 66 extending laterally through the first heat shield 34, baffle 56, and the second heat shield 58. As shown in FIG. 5, a simple washer 68 may be conventionally joined or welded to the end of the pin 66 to prevent its removal from the first heat shield 34 after final assembly. As shown in FIG. 7, the first heat shield 34, the baffle 56, and the second heat shield 58 have respective apertures 70*a,b,c* through which the respective pins 66 extend. As shown in FIG. 5, the respective apertures 70a,b,c are aligned together upon assembly so that a respective pin 66 may be inserted therethrough, with the washer 68 then being joined to the pin 66 for preventing the disassembly thereof. As shown in FIG. 3, three radially spaced apart ones of the pins 66 are used in the preferred embodiment, with the uppermost one of the pins 66 being disposed in complementary apertures, i.e. the uppermost ones of the apertures 70*a,b,c,* for suspending the baffle 56 and the second heat shield 58 from the first heat shield 34 and restraining longitudinal or radial movement therebetween at the top pin 66. As shown, the top pin 66 has a circular cross-section, with the respective apertures 70*a,b,c* also having circular cross-sections suitably larger than the outer diameter of the pin 66 for providing a suitable assembly clearance therebetween with minimal lateral movement.

However, in order to accommodate differential thermal expansion between the first heat shield 34, the baffle 56, and the second heat shield 58, the remaining, lower ones of the apertures 70*b,c* in the baffle 56 and second heat shield 58 are suitably larger in dimension than the pins 66 extending therethrough, and in the embodiments illustrated in FIGS. 3 and 7 have a longitudinally elongate racetrack-shaped configuration. The lower apertures 70*a* of the first heat shield 34 are also circular to suitably support the pins 66. In this way, both the first heat shield 34 and the second heat shield 58 may thermally expand more than the expansion of the relatively cold baffle 56 without restraint between these three components. The bottom two pins 66 are initially disposed at the top of their respective apertures 70*b* in the baffle 59 so that upon heating of the flameholder assembly 32, the first heat shield 34 may thermally grow radially inwardly with the pin 66 moving relatively radially inwardly in the apertures 70*b* without restraint. And, the bottom two pins 66 are initially disposed at the top of their respective apertures 70*c* in the second heat shield 58 so that the hot second heat shield 58 may expand radially inwardly relative to the colder baffle 56.

Accordingly, the flameholder assembly 32 includes a plurality of discrete components subject to different operating temperatures which are preferentially joined together for preventing or reducing restraint therebetween which would lead to undesirable low cycle fatigue thermal damage. The flameholder assembly 32 is cooled by the air 22 through both its first chamber 42 and its second chamber 44, with the impingement air discharged from the baffle holes 62 providing substantial impingement cooling of the first heat shield 34 by the walls of the second chamber 44, and similar cooling of the second heat shield 58 which is subjected to the highest heat flux. The resulting assembly is therefore effectively cooled with the relatively cold air 22 without imposing undesirably large thermal stresses caused by thermal growth mismatch of otherwise restrained components.

Furthermore, since the first and second chambers 42, 44 are separated by the septum 40, the spraybar 46 and therefore the fuel therein is isolated and further removed from the hot aft end of the flameholder assembly 32 that faces the combustion zone. And, any internal fuel leakage into the first chamber 42 is discharged out the end 38 and therefore combustion thereof due to hot surfaces is eliminated. In the event of damage to the second heat shield 58 as discussed above, the cooling flow through the baffle 56 itself will be unaffected to ensure continuity of cooling effectiveness. Furthermore, since the cooling flow though the baffle 56 does not contain any leakage fuel due to the imperforate septum 40, the risk of further possible damage to the assembly 32 from combustion of leakage fuel is reduced. The second heat shield 58 is preferably configured with a relatively close fit over the access opening 54 to minimize cooling air leakage therebetween. In this way, the cooling air within the second chamber 44 is confined to flow outwardly through the outlet 64 which provides additional protection to the augmenter liner 26 from any hot streaks associated with the flameholder itself.

As illustrated in FIGS. 2, 3, 6, and 7 the flameholder assembly 32 preferably also includes a circumferentially extending arcuate flameholder gutter 72 removably fixedly joined to the inner end 38 of the first heat shield 34 which extends laterally or circumferentially relative to the second heat shield 58. As shown in FIG. 3, the gutter 72 is generally V-shaped in cross-section in the circumferential direction, with the open end of the "V" facing downstream for providing cross-firing and additional flameholder capability along with the second heat shield 58. As shown in FIG. 2, the gutter 72 is a portion or segment of an entire ring of the collective gutters 72, but with each gutter 72 being suspended from or supported solely by its respective first heat shield 34 for unrestrained thermal movement therewith. If adjacent gutters 72 were joined together, undesirable restraint would be effected upon differential thermal expansion of the respective assemblies 32. By locating the gutters 72 at the radially inner ends of the first heat shields 34 and adjacent to the respective second heat shields 58 they cooperate with the second heat shields 58 to provide collective flameholding ability, with the gutters 72 promoting additional stability of the combustion process. By decoupling the individual gutters 72 from adjacent ones of the flameholders 32, the individual flameholders 32 are allowed to thermally expand and contract without restraint from the adjacent flameholders 32.

As illustrated in FIGS. 2–4 and 7, the flameholder 32 preferably also includes a relatively thin wing 74 fixedly integrally joined to the first heat shield 34 at the support end 36 thereof. The wing 74 preferably extends around the full perimeter of the first heat shield 34 with an increasing lateral projection from the upstream to downstream ends of the first heat shield 34. As shown in FIG. 7, the lateral projection of the wing 74 increases in magnitude and is greatest near the aft or downstream end of the first heat shield 34. The wing 74 preferably extends a suitable distance downstream from the aft end of the first heat shield 34 and overhangs the second heat shield 58 to obstruct gas flow radially downwardly over the wing 74 along the first and second heat shields 34, 58. As shown in FIG. 3, the wing 74 is disposed adjacent to the inner surface of the augmenter liner 26 and provides a barrier both for the cooling air 22 discharged from the outlet 64 as well as for the portion of the core gases 24 flowing adjacent to the inner surface of the augmenter liner 26. The wing 74 therefore promotes flame stability downstream of the second heat shield 58 by reducing radially inwardly directed secondary flow.

Figure 8:
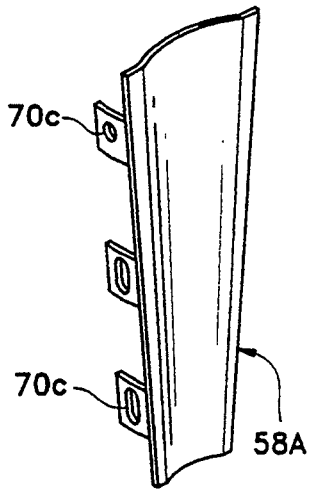
FIG. 8 is a perspective view of an alternate embodiment of the aft heat shield of the cooled flameholder assembly.

Illustrated in FIG. 8 is an alternate embodiment of the second heat shield designated 58A which is concave in transverse section to provide improved flame holding capability in some designs.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

We claim:

1. A cooled flameholder assembly comprising:

a first heat shield including a support end for being mounted to an annular casing; an elongate, enclosed, first chamber; an elongate, second chamber separated from said first chamber by a septum and having an access opening along one side thereof;

a fuel spraybar disposed inside said first chamber for discharging fuel from said first heat shield;

a hollow baffle disposed inside said second chamber and having an inlet at one end thereof for receiving cooling air, and a plurality of outlet holes therein for discharging said cooling air; and a second heat shield removably joined to said first heat shield for closing said access opening, and disposed adjacent to said baffle outlet holes for being impingement cooled thereby.

2. An assembly according to claim 1 further including means for supporting said baffle in said second chamber for allowing substantially unrestrained thermal expansion between said first heat shield and said baffle.

3. An assembly according to claim 2 further including means for supporting said second heat shield on said first heat shield for allowing substantially unrestrained thermal expansion between said second heat shield and said first heat shield.

4. An assembly according to claim 2 wherein said supporting means also supports said second heat shield on said first heat shield for allowing substantially unrestrained thermal expansion between said second heat shield and said first heat shield.

5. An assembly according to claim 4 wherein said supporting means comprises a plurality of longitudinally spaced apart pins extending laterally through said first heat shield, said baffle, and said second heat shield, with one of said pins being disposed in complementary apertures therein for restraining longitudinal movement therebetween, and the remainder of said pins being disposed in enlarged apertures in said baffle and said second heat shield for allowing predetermined longitudinal movement therein for accommodating thermal expansion between said first heat shield, said baffle, and said second heat shield.

6. An assembly according to claim 1 wherein said first heat shield further includes a spent air outlet disposed adjacent to said support end in flow communication with said second chamber for discharging from said second chamber said cooling air discharged from said baffle outlet holes after impingement against said first and second heat shields.

7. An assembly according to claim 1 further including a wing fixedly joined to said first heat shield at said support end thereof and extending outwardly from said second heat shield to obstruct gas flow over said second heat shield.

8. An assembly according to claim 1 further including an arcuate gutter removably fixedly joined to a second end of said first heat shield and extending laterally relative to said second heat shield, said gutter being supported solely by said first heat shield for unrestrained thermal movement therewith.

9. An assembly according to claim 8 wherein:

said first chamber is disposed on an upstream end of said first heat shield relative to core engine gases flowable thereover, and said second chamber is disposed on a downstream end of said first heat shield;

said second heat shield is substantially flat for providing flameholding capabilities; and said gutter is generally V-shaped in cross-section and opening downstream for providing additional flameholding capability along with said second heat shield.

10. An assembly according to claim 9 wherein:

said fuel spraybar includes a plurality of longitudinally spaced apart fuel outlets for discharging fuel; and said first heat shield includes a plurality of fuel ports aligned with respective ones of said fuel outlets for discharging said fuel from said first heat shield.

11. An assembly according to claim 8 wherein said second heat shield is concave in transverse section.

* * * * *